US006067945A

United States Patent [19]

Fukuda et al.

[11] Patent Number: 6,067,945

[45] Date of Patent: May 30, 2000

[54] ENGINE GENERATOR

[75] Inventors: Masahiro Fukuda; Toru Nishikura; Masaru Sakamoto, all of Nitta; Akira Fukuda; Takao Tamechika, both of Wako; Tsutomu Hatsugai, Wako, all of Japan

[73] Assignees: Sawafuji Electric Co., Ltd; Honda Giken Kogyo Kabushiki Kaisha, both of Tokyo, Japan

[21] Appl. No.: 09/145,412

[22] Filed: Sep. 1, 1998

[30] Foreign Application Priority Data

Sep. 9, 1997 [JP] Japan ..... 9-243584

[51] Int. Cl.[7] ..... F02B 63/00

[52] U.S. Cl. ..... 123/2; 123/198 E; 290/1 A; 322/1

[58] Field of Search ..... 123/2, 198 E, 123/3; 290/1 R, 1 A, 1 B, 1 C, 1 D; 322/1

[56] References Cited

U.S. PATENT DOCUMENTS

| | | | |
|---|---|---|---|
| 1,396,418 | 11/1921 | Gilliard | 123/41.86 |
| 1,526,988 | 2/1925 | Keilholtz et al. | 290/1 B |
| 1,573,883 | 2/1926 | Vining | 290/1 B |
| 3,046,899 | 7/1962 | Biefang | 290/1 R |
| 4,226,214 | 10/1980 | Palazzetti | 123/2 |
| 5,624,589 | 4/1997 | Latvis et al. | 219/133 |
| 5,928,535 | 7/1999 | Trinkner et al. | 290/1 A |

FOREIGN PATENT DOCUMENTS

| | | | |
|---|---|---|---|
| 481 864 | 1/1917 | France . | |
| 296 10 022 U1 | 10/1996 | Germany . | |
| 60-81426 | 5/1985 | Japan | 123/2 |
| 3-281937 | 12/1991 | Japan | 123/2 |
| 4-330338 | 11/1992 | Japan | 123/2 |
| 5-11367 | 2/1993 | Japan . | |

*Primary Examiner*—Erick R. Solis
*Assistant Examiner*—Brian Hairston
*Attorney, Agent, or Firm*—Arent Fox Kintner Plotkin & Kahn, PLLC

[57] ABSTRACT

An engine generator includes an engine having an intake device and an exhaust device which are connected to an engine body, a generator connected to the engine, and a fuel tank for supplying fuel to the engine. The engine, the generator and the fuel tank are mounted on a frame. In this engine generator, the intake device and the exhaust device are connected to an upper portion of the engine body having a cylinder axis extending vertically to protrude to opposite sides from the engine body, and the fuel tank is disposed sideways of the engine body and the generator below the intake device or the exhaust device. Thus, when a vertical engine is used, the fuel tank can be effectively disposed to avoid the production of a wasteful space, thereby providing reductions in size, weight and cost.

5 Claims, 11 Drawing Sheets

ENGINE GENERATOR

BACKGROUND OF THE INVENTION

1. Field of the Invention

The present invention relates to an engine generator comprising an engine including an intake device and an exhaust device which are connected to an engine body, a generator connected to the engine, and a fuel tank for supplying fuel to the engine, wherein the engine, the generator and the fuel tank are mounted on a frame.

2. Description of the Related Art

Such an engine generator is already known, for example, from Japanese Utility Model Application Laid-open No. 5-11367 and the like. In the known structure, an engine body is mounted on a frame with its cylinder axis disposed horizontally, and a fuel tank is mounted to the frame at an upper location in which it covers the engine and generator.

When a vertical engine with the cylinder axis of an engine body extending vertically is used in the engine generator, the intake device and the exhaust device connected to the engine body are disposed to protrude sideways from the engine body. Therefore, if the fuel tank is disposed above the engine and the generator as in the known engine generator, a wasteful space is produced below the exhaust or intake device within the frame. This is undesirable for providing reductions in size, weight and cost of the engine generator.

SUMMARY OF THE INVENTION

Accordingly, it is an object of the present invention to provide an engine generator wherein when a vertical engine is used, the fuel tank is disposed, so as to avoid the production of a wasteful space, which can contribute to reductions in size, weight and cost.

To achieve the above object, according to a first aspect and feature of the present invention, there is provided an engine generator comprising an engine including an intake device and an exhaust device which are connected to an engine body, a generator connected to the engine, and a fuel tank for supplying fuel to the engine, the engine, the generator and the fuel tank being mounted on a frame, wherein the intake device and the exhaust device are connected to an upper portion of the engine body having a cylinder axis extending vertically to protrude to opposite sides from the engine body, and the fuel tank is disposed sideways of the engine body and the generator below the intake device or the exhaust device.

With such arrangement, the fuel tank is disposed in a space produced sideways of the engine body below the intake device or the exhaust device. Thus, a wasteful space can be prevented from being produced within the frame, thereby providing reductions in size, weight and cost of the engine generator.

According to a second aspect and feature of the present invention, in addition to the first feature, a guard member is secured to the frame to cover a side of the fuel tank on the opposite side from the engine body and the generator, and the fuel tank is fixedly supported on the guard member. With such arrangement, the fuel tank is supported by the guard member for protecting the fuel tank, and hence, an exclusive part for supporting the fuel tank is not required, which can contribute to a reduction in number of parts.

According to a third aspect and feature of the present invention, in addition to the second feature, an elastomeric member for receiving a bottom of the fuel tank is attached to the frame. With such arrangement, even if the frame is vibrated with the operation of the engine and the generator, the vibration cannot be transmitted to the fuel tank, and the weight of the fuel tank can be supported.

According to a fourth aspect and feature of the present invention, in addition to the second feature, a control panel having a plug socket for taking out an electric power from the generator is mounted on the guard member. With such arrangement, an exclusive control panel is not required, which can contribute to a reduction in number of parts.

Further, according to a fifth aspect and feature of the present invention, in addition to the first feature, a pipe line for guiding fuel is connected to a bottom of the fuel tank, and a lower guard plate is secured to cover a connected portion of the pipe line to the fuel tank from below. With such arrangement, the connected portion can be protected, so that when the frame is placed on a floor surface, a projection from the floor surface does not strike against the connected portion.

The above and other objects, features and advantages of the invention will become apparent from the following description of the preferred embodiments taken in conjunction with the accompanying drawings.

BRIEF DESCRIPTION OF THE DRAWINGS

FIGS. 1 to 5 show a first embodiment of the present invention, wherein

FIG. 1 is a front view of an engine generator;

FIG. 2 is a side view taken in a direction of an arrow 2 in FIG. 1;

FIG. 3 is a plan view taken in a direction of an arrow 3 in FIG. 1;

FIG. 4 is a cross-sectional plan view taken along a line 4—4 in FIG. 2;

FIG. 5 is a sectional view taken along a line 5—5 in FIG. 4;

FIGS. 6 and 7 show a second embodiment of the present invention, wherein FIG. 6 is a side view of an engine generator, similar to FIG. 2, but according to the second embodiment;

FIG. 7 is a cross-sectional plan view taken along a line 7—7 in FIG. 6;

FIGS. 9 to 12 show a fourth embodiment of the present invention, wherein FIG. 9 is a cross-sectional plan view similar to FIG. 8, but according to the fourth embodiment;

FIG. 10 is a view taken in a direction of an arrow 10 in FIG. 9;

FIG. 11 is an enlarged sectional view taken along a line 11—11 in FIG. 10; and FIG. 12 is an enlarged sectional view taken along a line 12—12 in FIG. 10.

DETAILED DESCRIPTION OF THE PREFERRED EMBODIMENTS

The present invention will now be described by way of embodiments with reference to the accompanying drawings.

Figure 1:
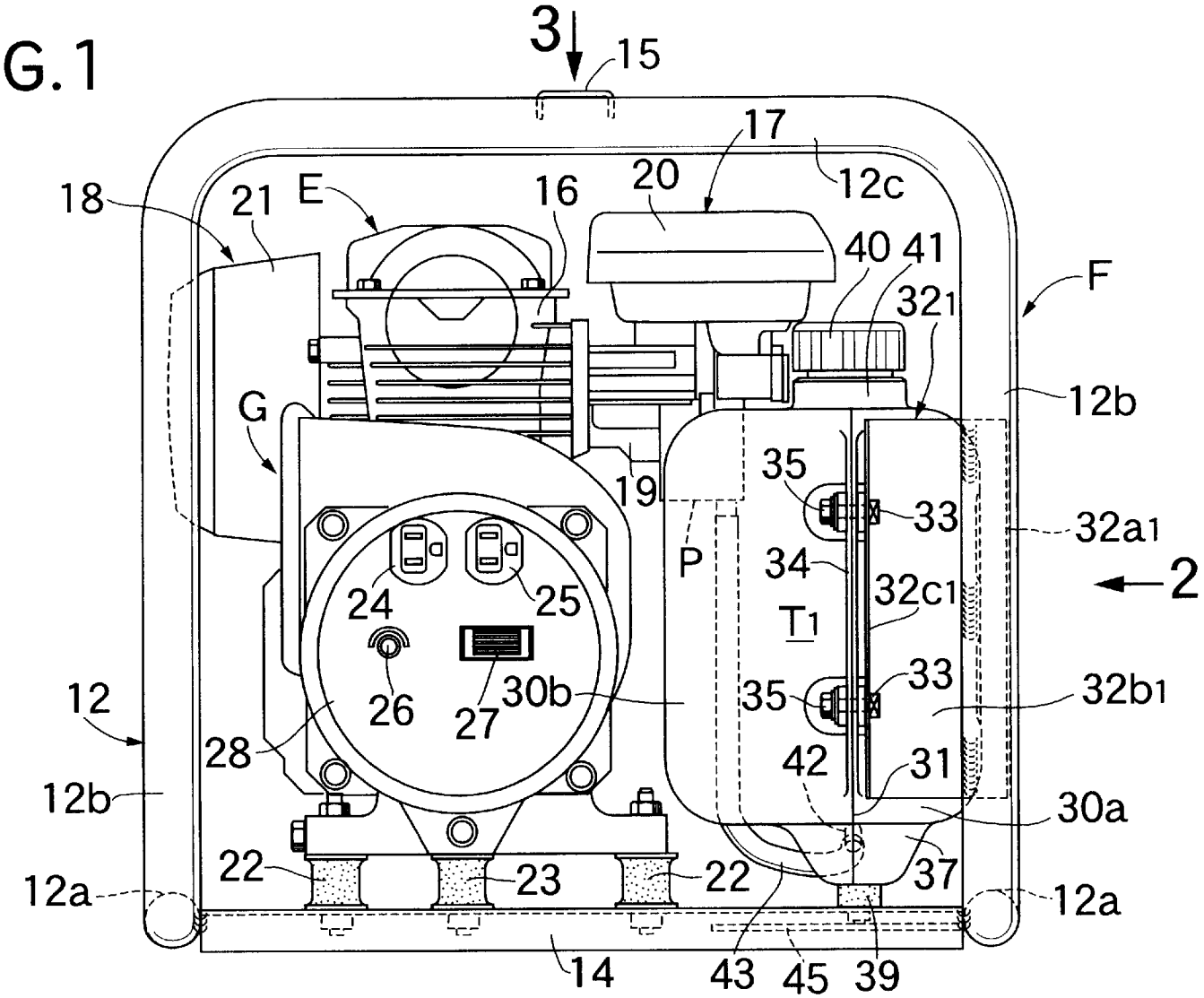
Figure 2:
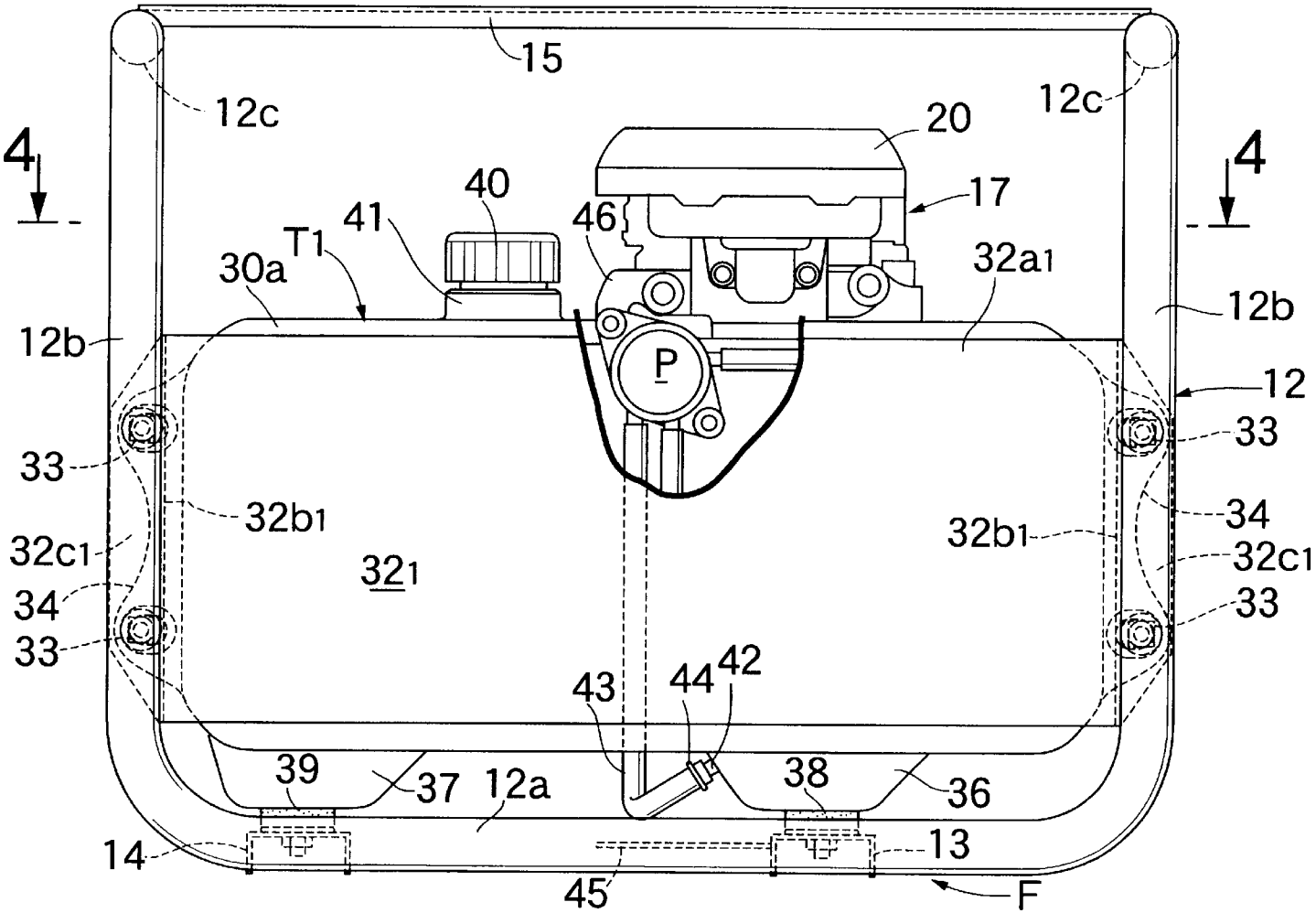
Figure 3:
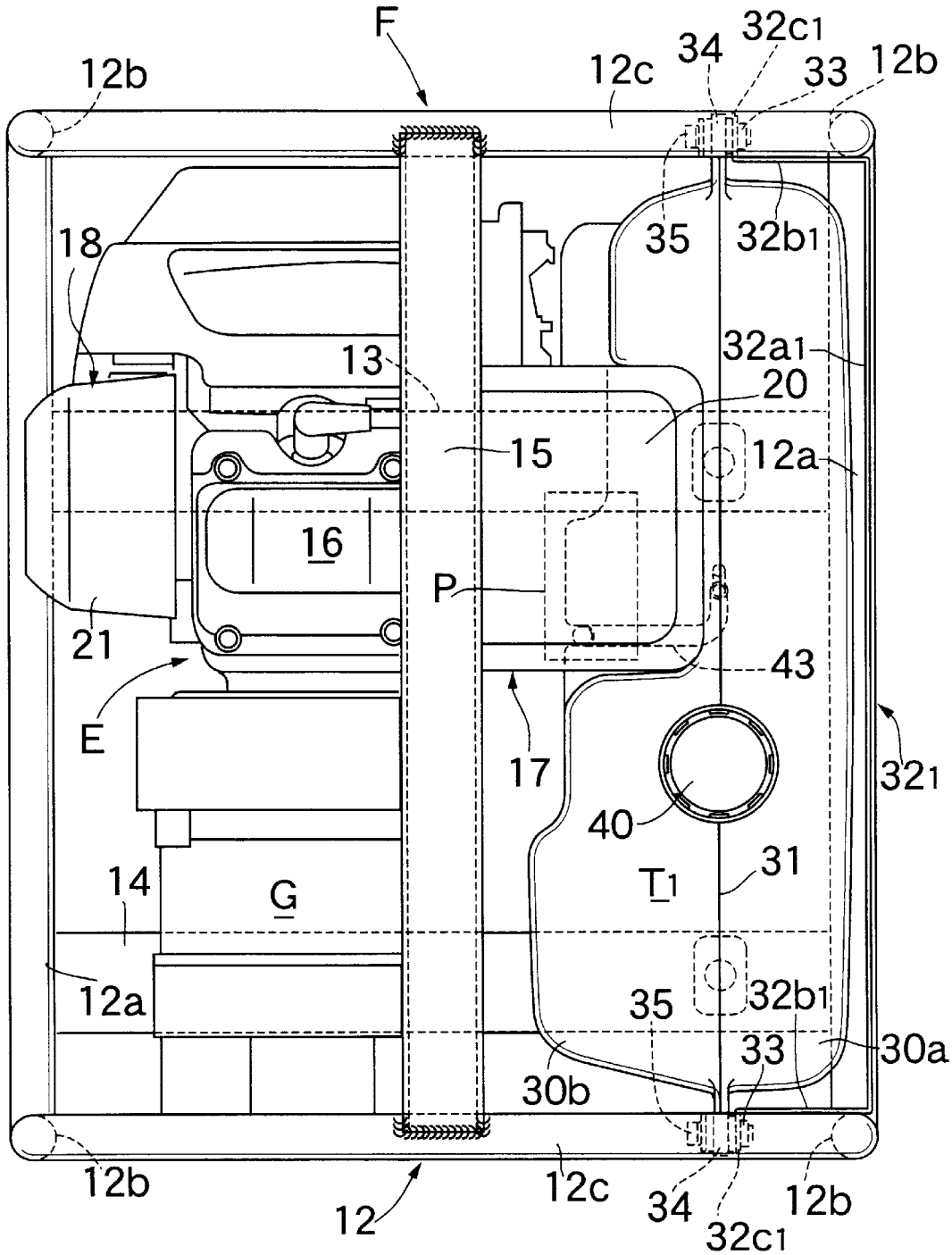

FIGS. 1 to 5 show a first embodiment of the present invention. Referring first to FIGS. 1 to 3, this transportable-type engine generator comprises an engine E, a generator G and an fuel tank $T_1$ which are mounted on a frame F. The frame F is comprised of a frame body 12 made by bending a rounded pipe, a pair of lower cross frame elements 13 and 14 secured to a lower portion of the frame body 12, and an upper cross frame element 15 secured to an upper portion of the frame body 12.

The frame body 12 includes a pair of lower side pipe portions 12*a* extending parallel to each other, four vertical pipe portions 12*b* risen upwards from opposite ends of the lower side pipe portions 12*a*, and a pair of upper side pipe portions 12*c* extending perpendicular to a direction of extension of the lower side pipe portions 12*a* and connecting upper ends of the pair of vertical pipe portions 12*b* to each other. The cross frame elements 13, 14 and 15 are made by channel-type steel. The cross frame elements 13 and 14 are mounted to extend between the lower side pipe portions 12*a* of the frame body 12, and the upper cross frame element 15 is mounted to extend between the upper side pipe portions 12*c* of the frame body 12.

The engine E comprises an engine body 16 having a cylinder axis disposed vertically, an intake device 17 having a carburetor 19 and an air cleaner 20, and an exhaust device 18 having a muffler 21. The intake device 17 is connected to an upper portion of the engine body 16 to protrude in one of sideways directions from the upper portion of the engine body 16, and the exhaust device 18 is connected to the upper portion of the engine body 16 to protrude in the other sideways direction from the upper portion of the engine body 16.

The engine body 16 is mounted on one of the lower cross frame elements 13 with a pair of rubber mount means 22 interposed therebetween. The generator G connected to a crankshaft (not shown) of the engine body 16 is disposed at a location adjacent the engine body 16 to extend in an axial direction of the crankshaft and is mounted on the other lower cross frame element 14 with a rubber mount means 23 interposed therebetween.

A control panel 28 is attached to an end surface of the generator G opposite from the engine body 16, and plug sockets 24 and 25 for taking out an electric power from the generator G, a switch 26 and an indicating lamp 27 and the like are disposed on the control panel 28.

Figure 4:
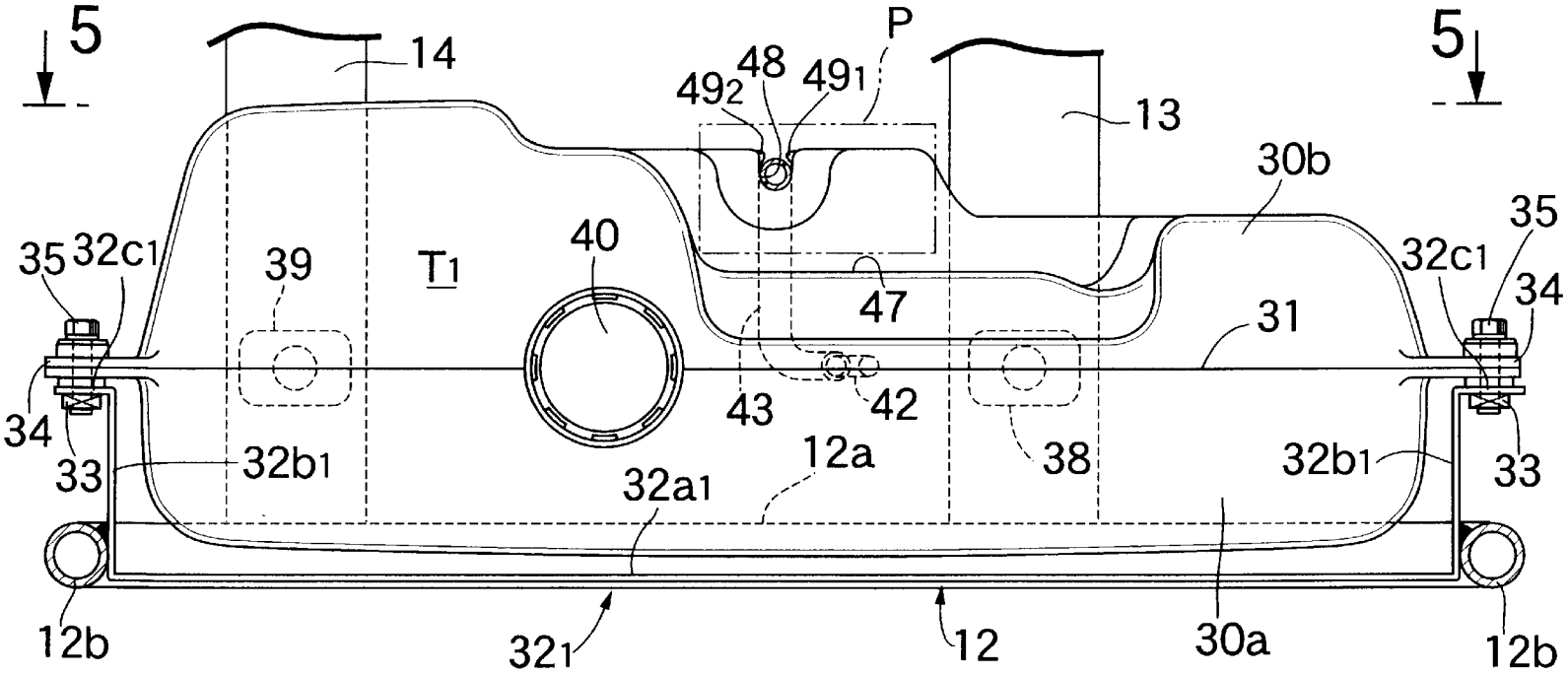
Figure 5:
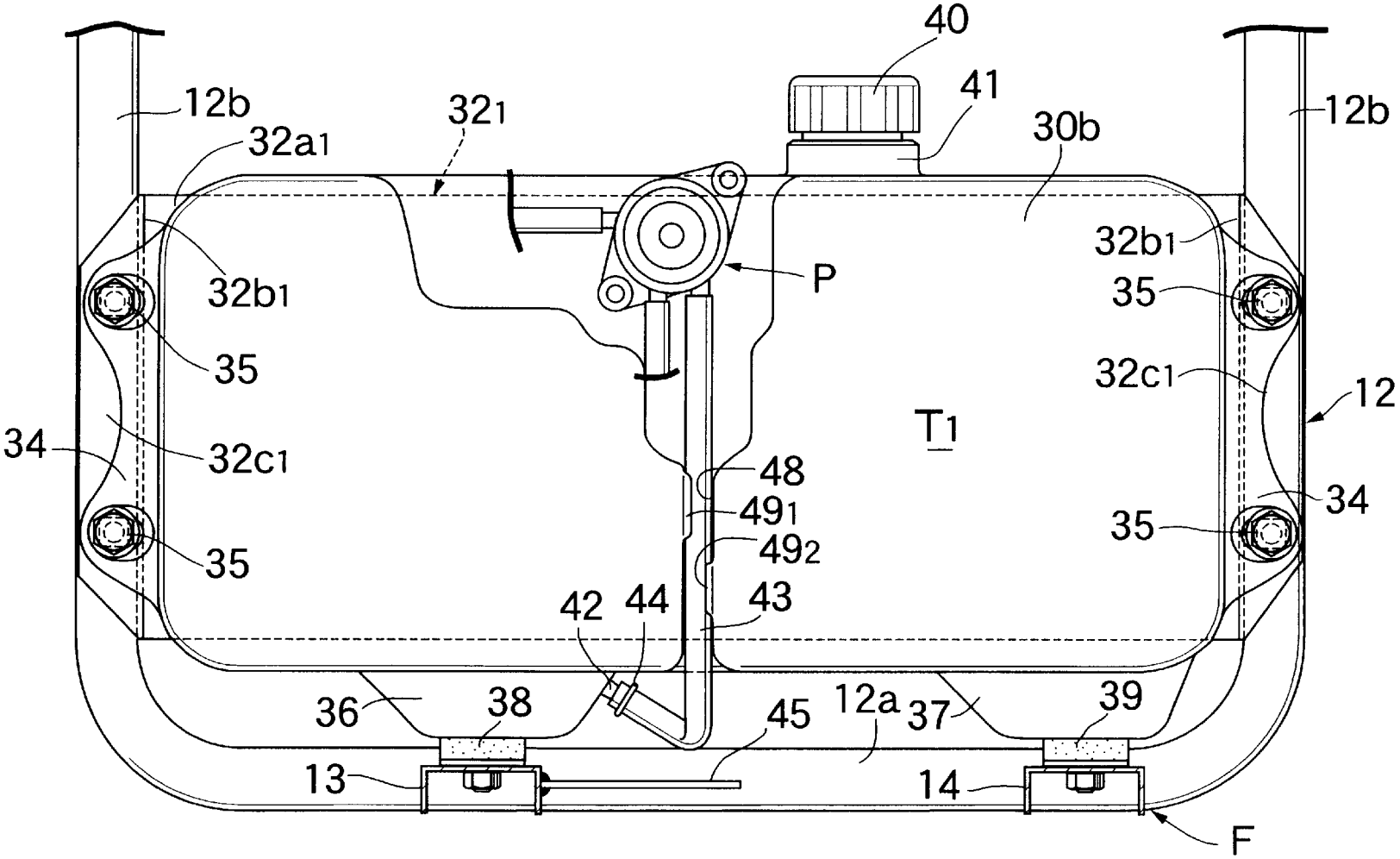

Referring also to FIGS. 4 and 5, the fuel tank $T_1$ is formed by thermally depositing a pair of halves 30*a* and 30*b* made of a synthetic resin to each other at a bonding face 31. The fuel tank $T_1$ is disposed sideways of the engine body 16 and the generator G below the intake device 17 in the engine E.

A guard member $\mathbf{32}_1$ is secured by welding to the pair of vertical pipe portions 12*b* in the frame body 12 of the frame F to cover the side of the fuel tank $T_1$ on the opposite side from the engine body 16 and the generator G.

The guard member $\mathbf{32}_1$ is integrally provided with a flat plate-like guard plate portion $\mathbf{32}a_1$ extending between the pair of vertical pipe portions 12*b*, a pair of support plate portions $\mathbf{32}b_1$ connected vertically to opposite ends of the guard plate portion $\mathbf{32}a_1$, and a pair of support collar portions $\mathbf{32}c_1$ connected vertically to tip ends of the support plate portions $\mathbf{32}b_1$ and extending outwards. A pair of nut or bolts are welded to connect to each of the support collar portions $\mathbf{32}c_1$.

Such guard member $\mathbf{32}_1$ is secured to the frame body 12, i.e. to the frame F in such a manner that the support plate portions $\mathbf{32}b_1$ inserted into between both of the vertical pipe portions 12*b* are welded to the vertical pipe portions 12*b*, respectively. In a state in which the guard member $\mathbf{32}_1$ has been secured to the frame F, the support collar portions $\mathbf{32}c_1$ are disposed at locations opposed to the vertical pipe portions 12*b* from inward.

On the other hand, the fuel tank $T_1$ is integrally provided at its opposite sides with flanges 34 opposed respectively to the support collar portions $\mathbf{32}c_1$ of the guard member $\mathbf{32}_1$. The flanges 34 are fastened to the support collar portions $\mathbf{32}c_1$ by tightening bolts 35 threadedly fitted in the nuts 33. Thus, the fuel tank $T_1$ is fixedly supported by the guard member $\mathbf{32}_1$ secured to the frame F. Insertion bores provided in the flanges 34 for a deviation in insertion of the bolts 35 are formed in such a large size as to permit the location of the bolts from the nuts 33 within a preset range.

The fuel tank $T_1$ is integrally provided at its bottom with legs 36 and 37 which protrude downwards in correspondence to the pair of lower cross frame elements 13 and 14 of the frame F. Elastomeric members 38 and 39 made of an elastic material such as a rubber are mounted on the lower cross frame elements 13 and 14, and the legs 36 and 17 are received on the elastomeric members 38 and 39.

In this manner, the fuel tank $T_1$ is fixedly supported on the frame F in such a manner that it is disposed sideways of the engine body 16 and the generator G below the intake device 17 in the engine E. A fuel injection pipe 41 is integrally provided at a location facing upwards without being not covered with the intake device 17 in the upper portion of the fuel tank $T_1$, in such a manner that an opening at the upper end is closed by a detachable cap 40.

A fuel outlet pipe 42 leading to the inside of the fuel tank $T_1$ is secured to one of the legs 36 at the bottom of the fuel tank $T_1$, and a pipe line 43 having a flexibility such as a rubber hose is connected at its one end to the fuel outlet pipe 42 by a clip 44.

Moreover, a lower guard plate 45 is welded to the lower cross frame element 13 to which the elastomeric member 38 receiving the leg 36 is attached and to one of the lower side pipe portion 12*a* to cover the connected portion of the pipe line 43 to the fuel outlet pipe 42 from below.

On the other hand, a fuel pump P for supplying fuel to the carburetor 19 of the engine E is disposed between the upper portion of the fuel tank T, and the engine body 16 and fixedly supported on a stay 46 (see FIG. 2) secured to the engine body 16. A recess 47 (see FIG. 4) for accommodating a portion of the fuel pump P is provided in an upper portion of the side of the fuel tank $T_1$ which is adjacent the engine body 16.

The pipe line 43 connected at its one end to the fuel outlet pipe 42 at the bottom of the fuel tank $T_1$ is provided to extend along the side of the fuel tank $T_1$ adjacent the engine body 16 up to the fuel pump P lying thereabove. A fitting groove 48, into which the pipe line 43 is resiliently fitted, is provided in the side of the fuel tank $T_1$ adjacent the engine body 16 to extend vertically, and a first retaining claw $\mathbf{49}_1$ and a second retaining claw $\mathbf{49}_2$ are also integrally provided on the side of the fuel tank $T_1$ adjacent the engine body 16. The first retaining claw $\mathbf{49}_1$ is connected to one of opening end edges of the fitting groove 48, and the second retaining claw $\mathbf{49}_2$ is connected to the other opening end edge of the fitting groove 48. The first and second retaining claws $\mathbf{49}_1$ and $\mathbf{49}_2$ are disposed at locations deviated from each other in a lengthwise direction of the fitting groove 48 in order to simplify a forming die for the fitting groove 48 formed simultaneously with the formation of the half $\mathbf{30}_2$ of the fuel tank $T_1$ and to facilitate drawing of the die.

The operation of the first embodiment will be described below. The intake device 17 is connected to the upper portion of the engine body 16 having the cylinder axis disposed vertically, so as to protrude sideways from the engine body 16, and the fuel tank $T_1$ is fixed to the frame F in such a manner that it is disposed sideways of the engine body 16 and the generator G below the intake device 17. Therefore, the fuel tank $T_1$ is effectively disposed in a space produced sideways of the engine body 16 below the intake device 17. Thus, it is possible to prevent a wasteful space from being produced within the frame F, thereby providing reductions in size, weight and cost of the engine generator.

The guard member $\mathbf{32}_1$ is secured to the frame F to cover the side of the fuel tank $T_1$ on the opposite side from the engine body 16 and the generator G, and the fuel tank $T_1$ is fixedly supported to the guard member $\mathbf{32}_1$. Therefore, an exclusive part for supporting the fuel tank is not required, which can contribute to a reduction in number of parts.

Further, the elastomeric members 38 and 39 receiving the bottom of the fuel tank $T_1$ are attached to the lower cross frame elements 13 and 14 of the frame F, and hence, even if the frame F is vibrated with the operation of the engine E and the generator G, the vibration cannot be transmitted to the fuel tank $T_1$.

The connected portion of the pipe line 43 to the fuel tank $T_1$ is covered from below with the lower guard plate 45 secured to the cross frame element 13 and the lower side pipe portion 12*a*. Therefore, the connected portion can be protected, so that when the engine generator is placed on a floor surface, the projection from the floor surface does not strike against the connected portion of the pipe line 43 to the fuel tank $T_1$.

Further, the pipe line 43 for feeding the fuel from the fuel tank $T_1$ to the fuel pump P is resiliently fitted in the fitting groove 48 provided in the side of the fuel tank $T_1$, and the fitted state of the pipe line 43 in the fitting groove 48 is retained by the first and second retaining claws $\mathbf{49}_1$ and $\mathbf{49}_2$ connected to the opening end edges of the fitting groove 48. Therefore, a part for fixing the pipe line 43 is not required other than the fuel tank $T_1$, which enables a reduction in number of parts.

Figure 6:
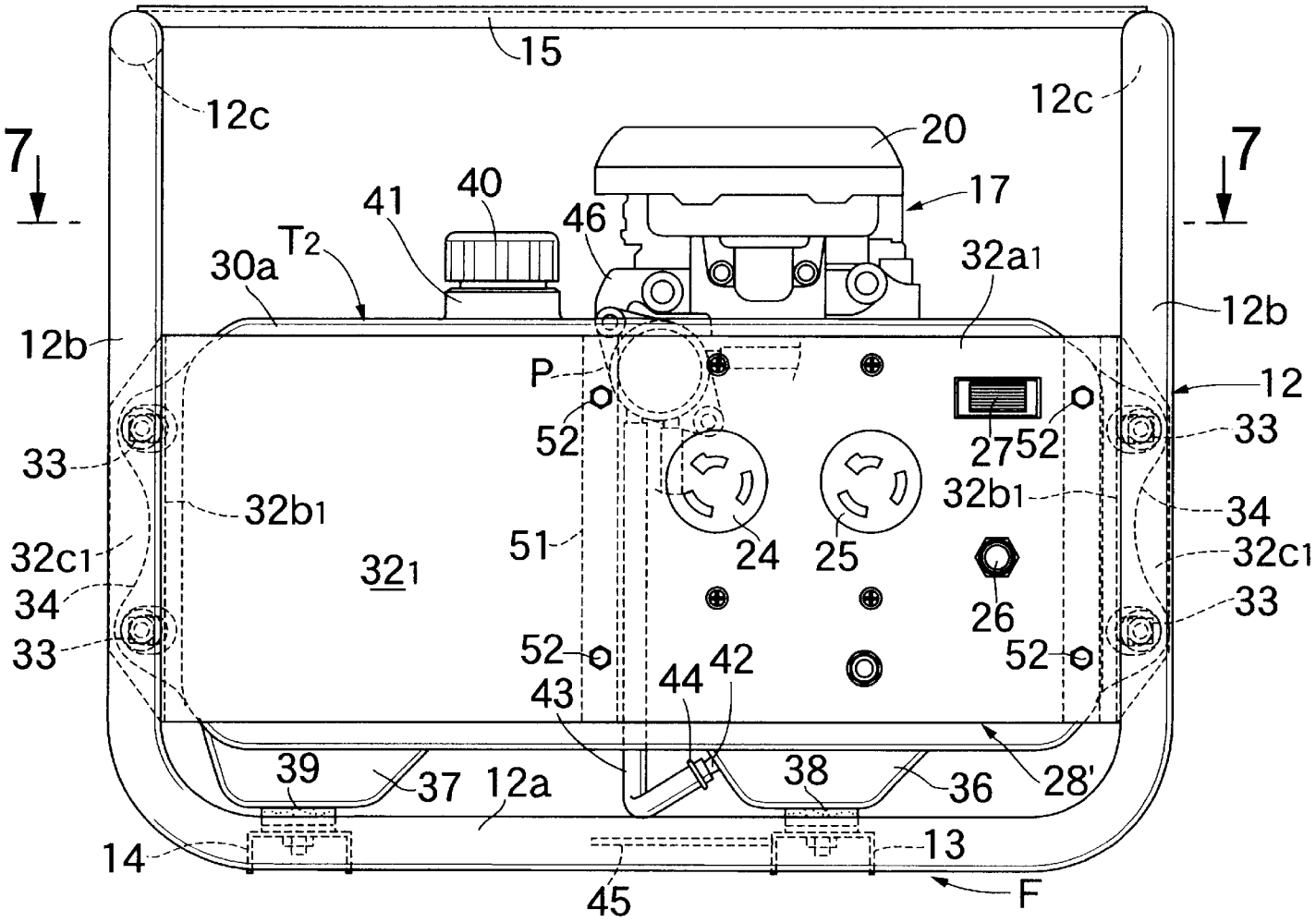
Figure 7:
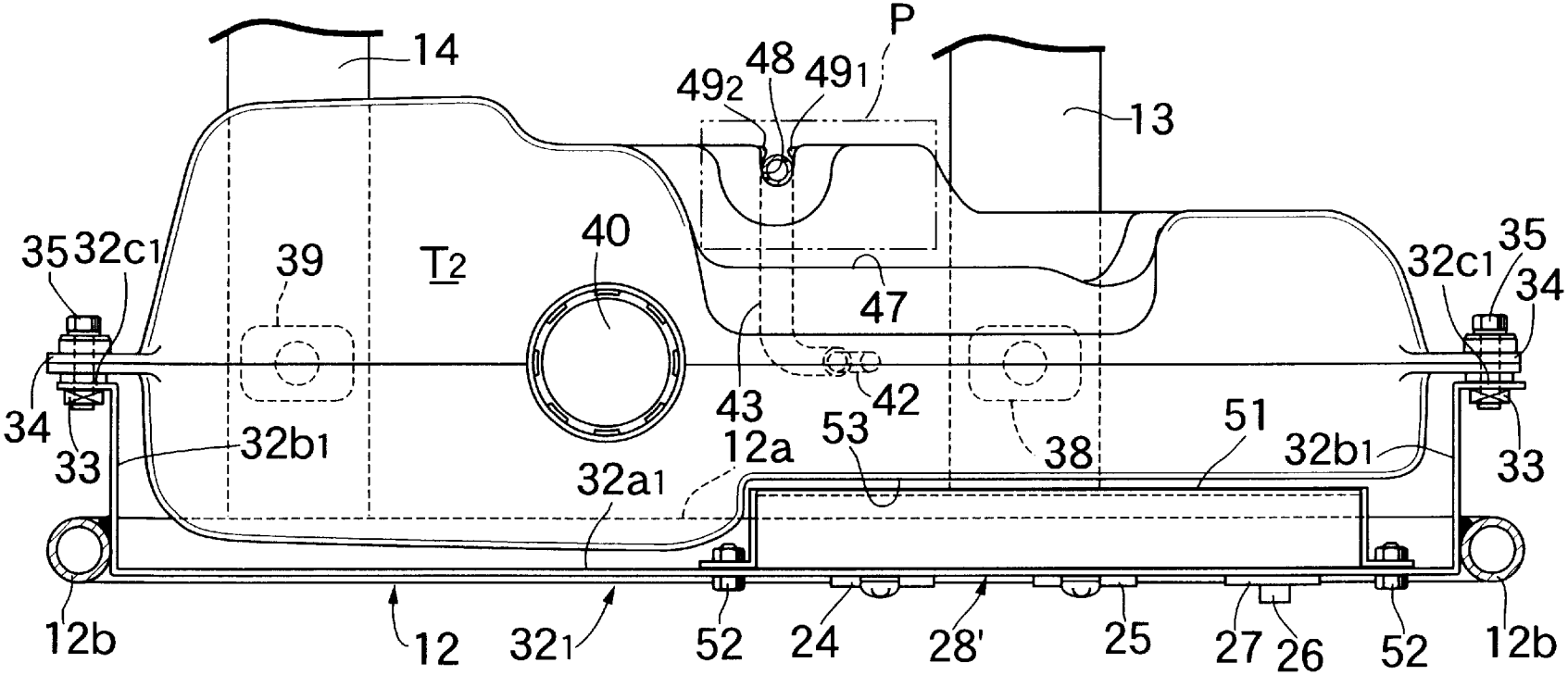

FIGS. 6 and 7 show a second embodiment of the present invention.

A control box 51 is attached to a back surface of a guard plate portion $\mathbf{32}a_1$ of a guard member $\mathbf{32}_1$ by a plurality of threaded members 52. The guard plate portion $\mathbf{32}a_1$, functions at its area corresponding to the control box 51 as a control panel 28'. Plug sockets 24 and 25 for taking out an electric power from the generator G, switch 26 and an indicating lamp 27 and the like are disposed in the control panel 28'.

Moreover, a recess 53 for accommodating a portion of the control box 51 is provided on a fuel tank $T_2$ having a side covered with the guard member $\mathbf{32}_1$.

With the second embodiment, by the fact that the control panel 28' having the plug sockets 24 and 25 for taking out the electric power from the generator and the like is provided in the guard member $\mathbf{32}_1$, it is unnecessary to attach the control panel 28 to the generator G and the like as in the first embodiment. This can contribute to a reduction in number of parts and a compactness of the engine generator.

Figure 8:
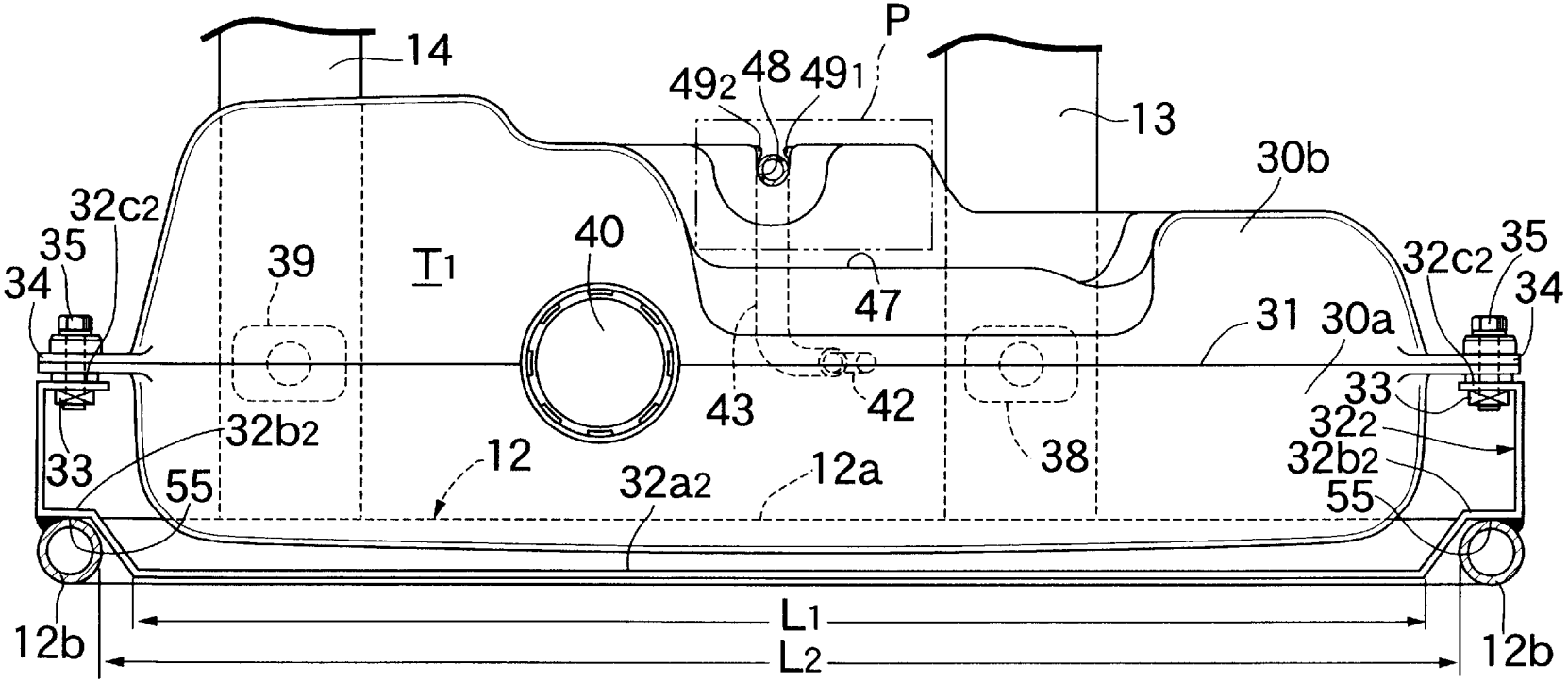
FIG. 8 is a cross-sectional plan view similar to FIG. 7, but according to a third embodiment.
Figure 9:
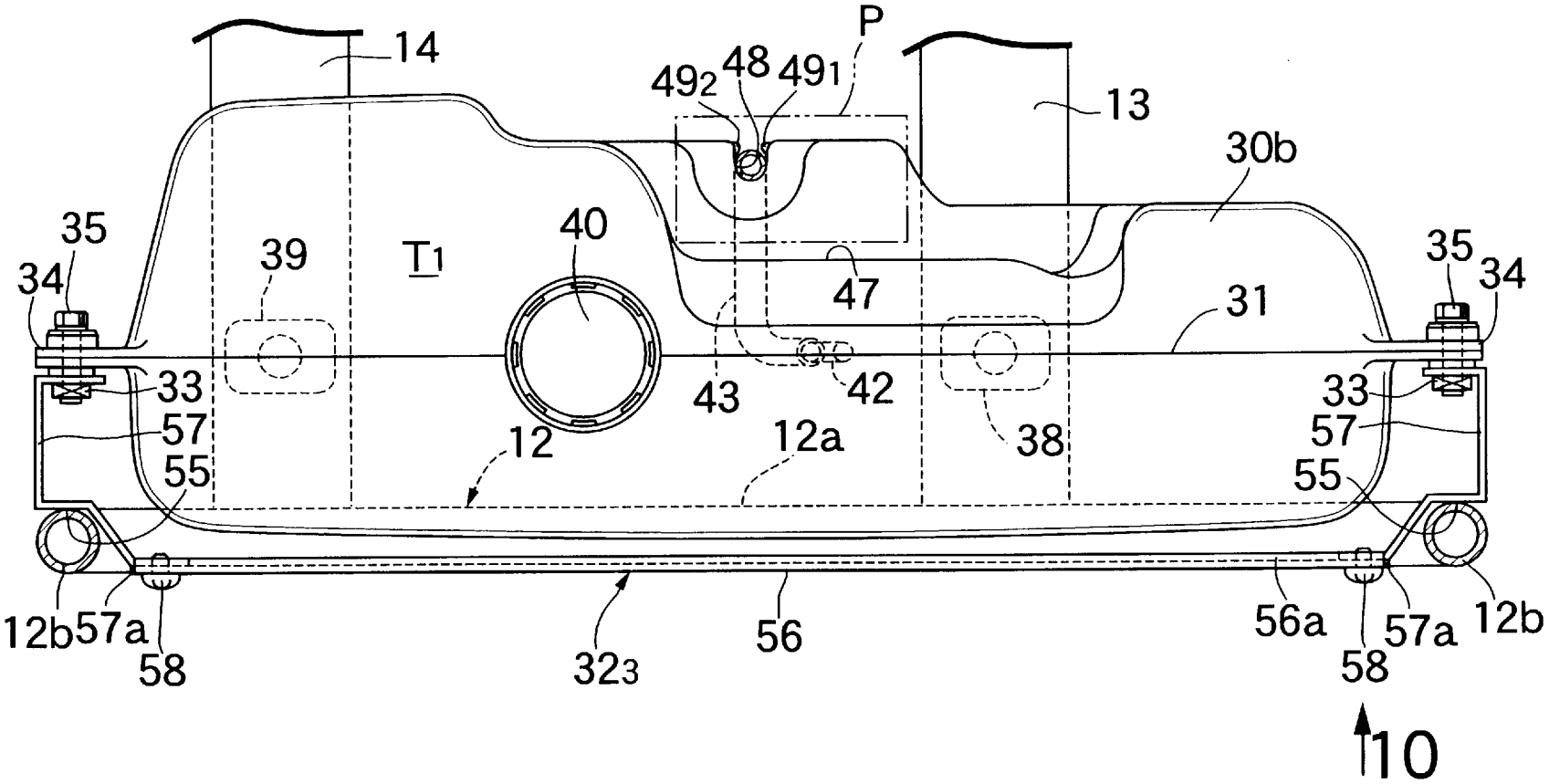
Figure 10:
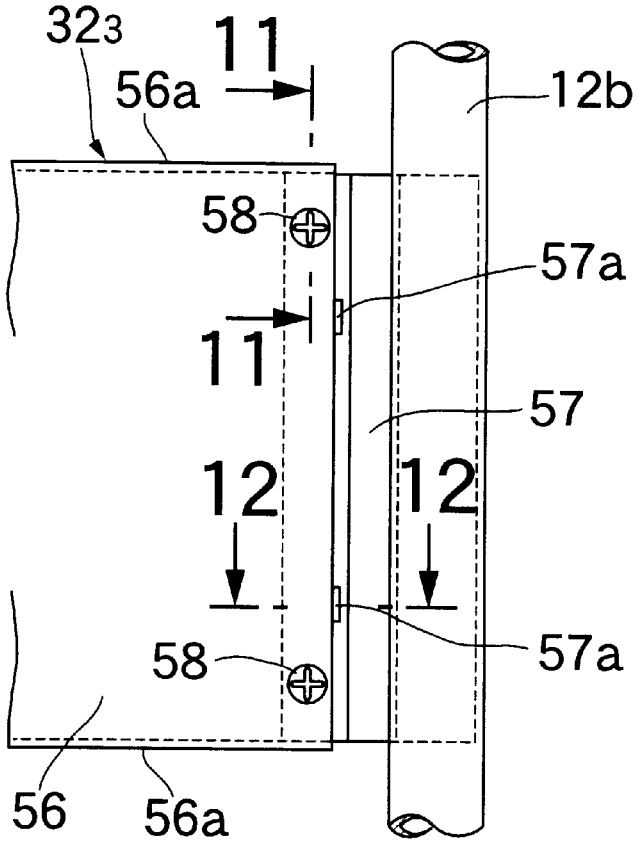
Figure 11:
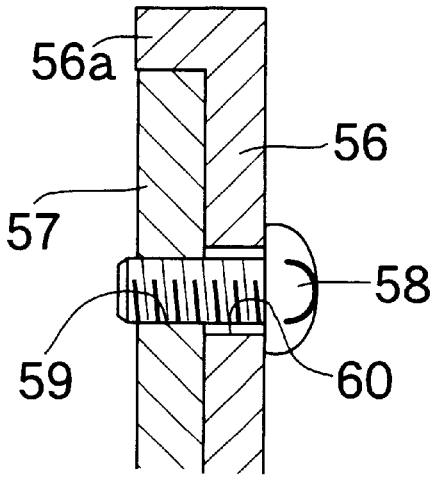
Figure 12:
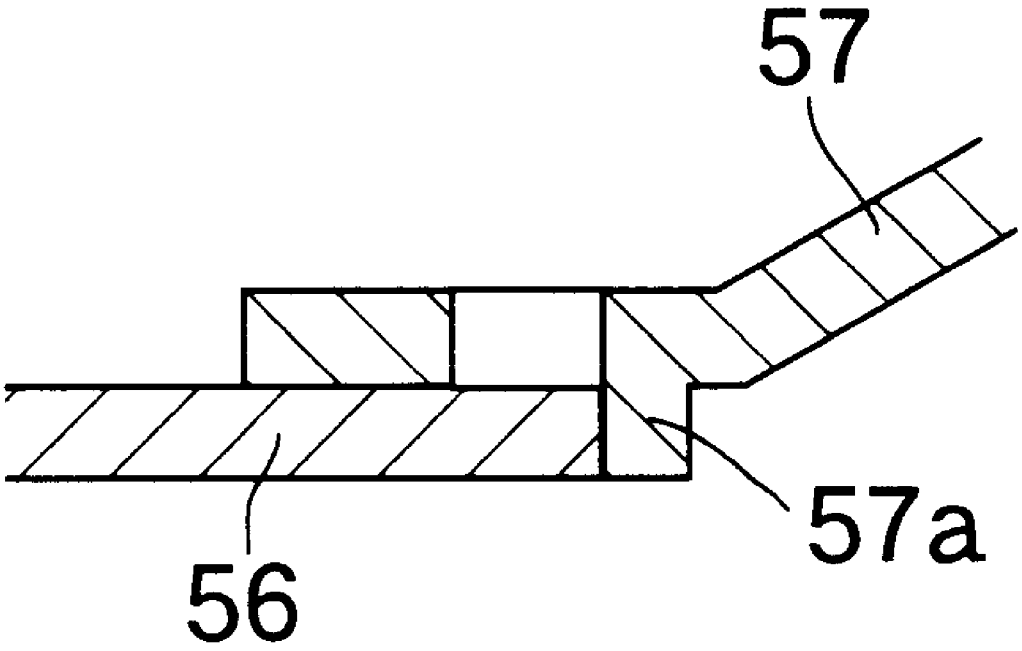

FIG. 8 shows a third embodiment of the present invention. A guard member $\mathbf{32}_2$ covering a side of a fuel tank $T_1$ is integrally provided with a flat plate-like guard plate portion $\mathbf{32}a_2$, a pair of support plate portions $\mathbf{32}b_2$ connected to opposite ends of the guard plate portions $\mathbf{32}a_2$ and having abutment steps 55 which are abutable against the vertical pipe portions 12*b* of the frame body 12 from inward, and a pair of support collar portions $\mathbf{32}c_2$ connected vertically to tip ends of the support plate portions $\mathbf{32}b_2$ and extending outwards. A pair of nuts 33 or bolts for fastening the flanges 34 of the fuel tank $T_1$ are welded to each of the support collar portions $\mathbf{32}c_2$.

Moreover, the length $L_1$ between opposite side ends of the guard plate portions $\mathbf{32}a_2$ is set smaller than a distance $L_2$ between the vertical pipe portions 12*b* ($L_1<L_2$), and the abutment steps 55 are welded to the vertical pipe portions 12*b*.

In the first and second embodiments, the support plate portions $\mathbf{32}b_1$ of the guard member $\mathbf{32}_1$ are inserted into between both the vertical pipe portions 12*b* and welded to the vertical pipe portions 12*b* and hence, it is necessary to accurately determine the length between the opposite side ends of the guard plate portions $\mathbf{32}a_1$ corresponding to the distance $L_2$ between the vertical pipe portions 12*b*. With the third embodiment, however, even if the length $L_1$ between the opposite side ends of the guard plate portion $\mathbf{32}a_2$ is set relatively roughly, the abutment steps 55 can be brought into abutment against and welded to the vertical pipe portions 12*b*, leading to an easy dimensional control.

FIGS. 9 to 12 show a fourth embodiment of the present invention.

In this engine generator, a guard member $\mathbf{32}_3$ having a basic shape similar to that of the guard member $\mathbf{32}_2$ in the third embodiment is used. The guard member $\mathbf{32}_3$ is comprised of support plates 57 fastened to opposite sided ends of the guard plate 56.

The guard plate 56 is formed similar to the guard plate portion $\mathbf{32}a_2$ of the guard member $\mathbf{32}_2$ provided in the third embodiment, but engagement collar portions 56*a* are integrally provided at vertical opposite ends of the guard plate 56 to protrude toward the fuel tank $T_1$. The support plate 57 is formed to have a shape similar to those of the support plate portion $\mathbf{32}b_2$ and the support collar portion $\mathbf{32}c_2$ of the guard member $\mathbf{32}_2$ provided in the third embodiment. An abutment step 55 is provided on the support plate 57 to abut against the vertical pipe portion 12*b*, and a nut 33 or a bolt for fastening the support plate 57 to the flange 34 of the fuel tank $T_1$ is welded to the support plate 57.

A portion of the support plate 57 is superposed on the side end of the guard plate 56 with its vertical opposite ends engaged with the engagement collar portions 56*a* of the guard plate 56. A pair of limiting projections 57*a* are integrally formed on the support plate 57*a* by cutting and rising, and the side end of the guard plate 56 is brought into abutment against the limiting projections 57*a*.

Threaded bores 59 are provided at a plurality of points, e.g., two points vertically spaced apart from each other in opposite sides of the guard plate 56, and threaded members 58 are inserted through insertion bore 60 provided in the support plate 57 in correspondence to the threaded bore 59. Thus, the support plate 57 is fastened to the guard plate 56 by threaded fitting of the threaded member 58 into the threaded bores 59.

In securing the guard member $\mathbf{32}_3$ to the frame F, the guard plate 56 and the support plates 57 are previously separated, and the abutment steps 55 of the support plate 57 are welded to the vertical pipe portions 12*b*, respectively. Therefore, the securing of the guard member $\mathbf{32}_3$ to the frame F may be carried out using the support plates 57 which have been separated from the guard plate 56 and which are relatively small in size and light in weight. Thus, the workability of welding is enhanced.

After securing of the support plates 57 to the vertical pipe portions 12*b*, the guard plate 56 may be fastened to the support plates 57. During this fastening, the vertical opposite ends of the support plates 57 are brought into engagement with the engagement collar portions 56*a* of the guard plate 56, whereby even if an operator releases his hand from the guard plate 56, the guard plate 56 can be retained between the support plates 57. In addition, the lateral movement of the guard plate 56 is limited by the limiting projections 57*a* of the support plates 57 and hence, the operation of fastening of the guard plate 56 to the support plates 57 can be easily and efficiently carried out.

Since the guard plate 56 and the support plates 57 are capable of being separated from each other in the above manner, the thickness of the guard plate 56 and the thickness of the support plates 57 can be set independently from each other. In addition, by preparing a plurality of the guard plates 56 having different coating colors, any of the coating color can be selected, leading an increased degree of freedom in design.

Although the embodiments of the present invention has been described in detail, it will be understood that the present invention is not limited to the above-described embodiments, and various modifications may be made without departing from the spirit and scope of the invention defined in claims.

For example, the fuel tank $T_1$, $T_2$ has been disposed below the intake device in each of the embodiments, but the fuel tank may be disposed below the exhaust device 18.

What is claimed is:

1. An engine generator comprising:

an engine including an intake device and an exhaust device which are connected to an engine body;

a generator connected to said engine; and a fuel tank to supply fuel to said engine;

wherein said engine, said generator and said fuel tank are mounted on a frame, and wherein said intake device and said exhaust device are connected to an upper portion of said engine body having a vertical cylinder axis extending therefrom such that said intake and exhaust devices each protrude from opposite sides of said engine body, and said fuel tank is disposed to extend along and to the side of both said engine body and said generator, said fuel tank having a longitudinal axis parallel to an axial direction of a crankshaft of the engine body, said fuel tank located below one of either said intake device and said exhaust device.

2. An engine generator according to claim 1, further including a guard member which is secured to said frame to cover a side of said fuel tank on the opposite side from said engine body and said generator, said fuel tank being fixedly supported on said guard member.

3. An engine generator according to claim 2, further including an elastomeric member attached to said frame for receiving a bottom of said fuel tank.

4. An engine generator according to claim 2, further including a control panel having a plug socket for taking out an electric power from said generator, said control panel being mounted on said guard member.

5. An engine generator according to claim 1, further including a pipe line connected to a bottom of said fuel tank for guiding fuel, and a lower guard plate secured to cover a connection portion of said pipe line and said fuel tank from below.

* * * * *